US011465159B2

(12) United States Patent
Huyghe et al.

(10) Patent No.: US 11,465,159 B2
(45) Date of Patent: Oct. 11, 2022

(54) DECANTER CENTRIFUGE WITH ADJUSTABLE BUSHINGS

(71) Applicant: ANDRITZ S.A.S., Châteauroux (FR)

(72) Inventors: Jean-Marc Huyghe, Le Poinconnet (FR); Denis Lamy, Chateauroux (FR); Laurentiu Pasol, Houilles (FR)

(73) Assignee: Andritz S.A.S., Chateauroux (FR)

( * ) Notice: Subject to any disclaimer, the term of this patent is extended or adjusted under 35 U.S.C. 154(b) by 399 days.

(21) Appl. No.: 16/603,300

(22) PCT Filed: Mar. 26, 2018

(86) PCT No.: PCT/EP2018/057637
§ 371 (c)(1),
(2) Date: Oct. 7, 2019

(87) PCT Pub. No.: WO2018/202358
PCT Pub. Date: Nov. 8, 2018

(65) Prior Publication Data

US 2021/0114042 A1 Apr. 22, 2021

(30) Foreign Application Priority Data

May 4, 2017 (EP) ..... 17169366

(51) Int. Cl.
*B04B 1/20* (2006.01)

(52) U.S. Cl.
CPC ..... *B04B 1/20* (2013.01); *B04B 2001/2083* (2013.01); *B04B 2001/2091* (2013.01)

(58) Field of Classification Search
CPC ..... B04B 1/20; B04B 2001/2083; B04B 2001/2091
(Continued)

(56) References Cited

U.S. PATENT DOCUMENTS 3,520,473 A * 7/1970 Gilreath ..... B04B 1/20 494/43
5,244,584 A * 9/1993 Schlieperskoetter ..... B04B 1/20 209/210
(Continued)

FOREIGN PATENT DOCUMENTS

DE 3345400 * 6/1985 ..... B04B 1/20
DE 3345400 A1 6/1985
(Continued)

OTHER PUBLICATIONS

DE 3345400 Description and Claims Espacenet machine translation.*
(Continued)

*Primary Examiner* — Shuyi S. Liu
(74) *Attorney, Agent, or Firm* — Alix, Yale & Ristas, LLP

(57) ABSTRACT

A decanter centrifuge includes a centrifugal bowl rotatable around a preferably horizontal axis of rotation including at least one liquid phase discharge outlet at one end and at least one solids discharge opening at the other end, a scroll conveyor mounted substantially concentrically inside the bowl for rotation about the axis of rotation of the centrifugal bowl at a slightly different speed relative to the bowl for transporting the solid phase towards the solids discharge opening. The liquid phase discharge is enabled through port members. A set of bushings for solid discharge is provided to adjust the solid discharge diameter inside the bowl. With these bushings optimal cake discharge may be achieved.

19 Claims, 7 Drawing Sheets

(58) Field of Classification Search
USPC ..... 494/43, 52, 53, 55, 56
See application file for complete search history.

(56) References Cited

U.S. PATENT DOCUMENTS

| | | | | |
|---|---|---|---|---|
| 7,311,654 | B2 | 12/2007 | Ostkamp | |
| 8,419,607 | B2 | 4/2013 | Mackel et al. | |
| 9,393,574 | B1 | 7/2016 | Morris | |
| 2006/0089247 | A1* | 4/2006 | Ostkamp | B04B 1/20 494/53 |

FOREIGN PATENT DOCUMENTS

| | | | |
|---|---|---|---|
| EP | 0747127 | B1 | 4/2002 |
| EP | 0798045 | B1 | 7/2002 |
| FR | 778407 | A | 3/1935 |
| JP | 5169965 | U | 6/1976 |
| JP | 6074750 | U | 5/1985 |
| WO | 2012003407 | A2 | 1/2012 |

OTHER PUBLICATIONS

International Search Report and Written Opinion dated Jun. 19, 2018 (PCT/EP2018/057637).
International Preliminary Report on Patentability dated Mar. 29, 2019 (PCT/EP2018/057637).

* cited by examiner

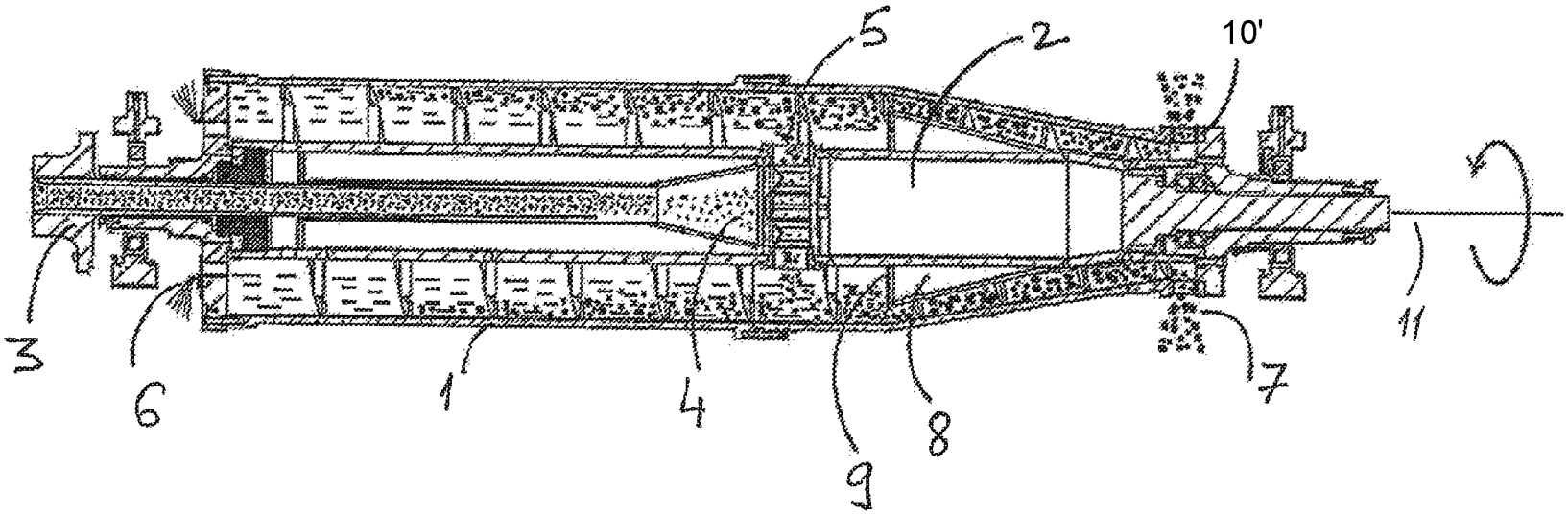
Fig. 1 - Prior Art

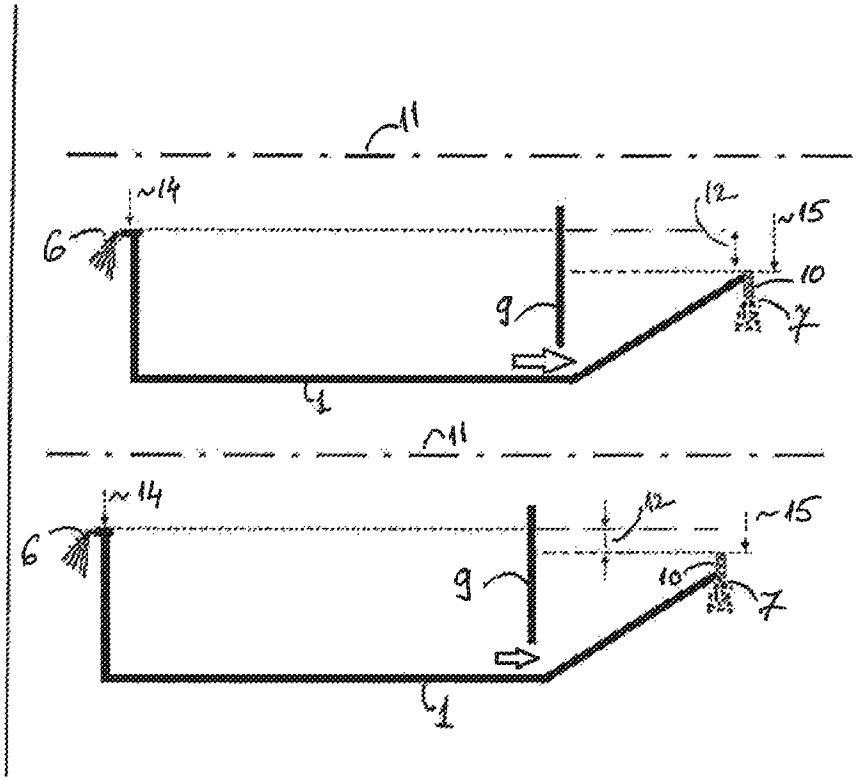
Fig. 2B
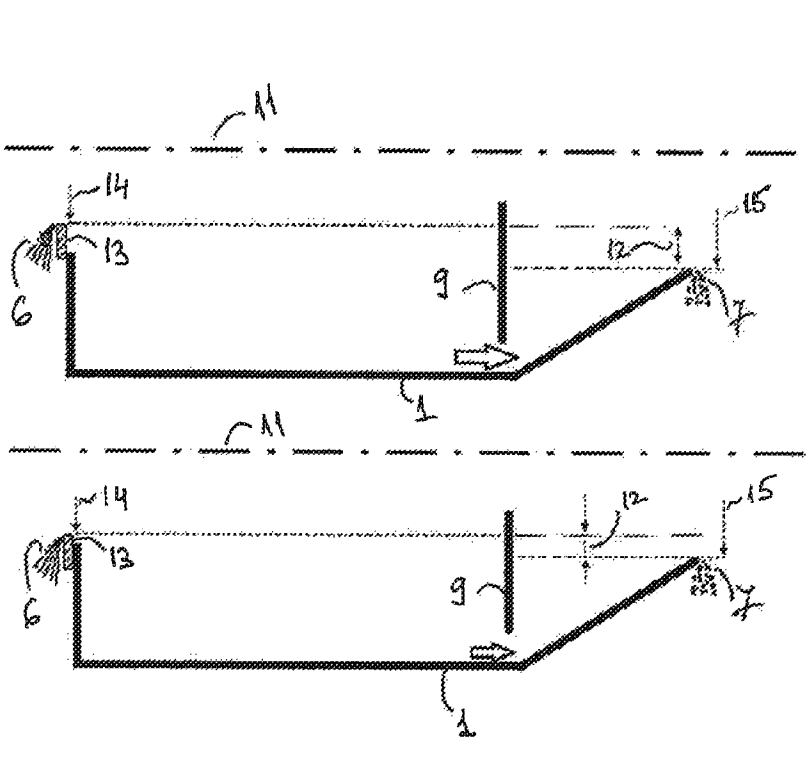
Fig. 2A - Prior Art

DECANTER CENTRIFUGE WITH ADJUSTABLE BUSHINGS

BACKGROUND

The disclosed embodiments relate to a decanter centrifuge comprising a centrifugal bowl rotating around a preferably horizontal axis of rotation including at least one liquid discharge outlet at one end and at least one solids discharge opening at the other end, and a scroll conveyor mounted substantially concentrically inside the bowl for rotation of said centrifugal bowl at a slightly different speed relative to the bowl for transporting the solid phase towards said solids discharge openings.

Among the factors affecting cake moisture are long residence time and compacting pressure on the cake. One part of the compacting pressure can be generated by the hydraulic pressure of liquid column difference between solid and liquid discharges which is used to compact the cake at the baffle/cone and to support scroll transportation towards the conical section. Besides the rotational speed, differential speed between bowl and scroll and torque control of the scroll conveyor, the relative pond depth (difference between liquid and solids discharge diameters) represents an important parameter to operate a decanter. At the end of the feed tube slurry enters the decanter centrifuge through the feed ports of the feed chamber. Said slurry is separated in at least one clarified liquid moving through liquid outlets and a separated solid (cake) which is transported by the scroll towards and through solids discharge openings.

Different concepts have been proposed to change the relative pond depth. The most common way to vary the hydraulic pressure generated by the relative pond depth is the weir plate or port member installed at the liquid discharge where it can be adjusted radially in order to change the diameter of the liquid discharge at the same time as keeping the solids discharge diameter fixed. This way to change the relative pond level, however, has some limits for deep pond decanters where there is too little space to adjust the pond depth radially at the liquid discharge side. In addition this adjustment on a small radius has lower effect on the hydraulic pressure than adjustment at the solids discharge openings.

In EP 0 747 127 A2 is proposed an adjustable gate mounted on the hub of the scroll conveyor with a locking mechanism which can control the cake compaction at the solids discharge openings. This system is used to improve cake moisture or it is an additional method for operating a decanter centrifuge.

In EP 0 798 045 A1 is presented a system to control the flow of solid discharge by varying the cross-sectional area of the solids discharge openings with a sleeve which can help to improve moisture content in the cake and it can be used as an additional method for operating a decanter centrifuge.

Another system to control flow of solids discharge openings is shown in U.S. Pat. No. 7,311,654 B2 where the adjusting of cross-section is made by a disk adjustable in the axial direction.

The patent application WO 2012/003407 A2 presents a cone-less decanter with a baffle where the solid lifts from the bowl wall in a radially inward manner along a plough and is pumped into a heavy phase discharge flow where it is re-suspended and exits the machine with that flow. There is no level difference on the two sides of the baffle. In order to adjust the solid phase flow across the baffle, air injection is used to change the density at one side of the baffle and thus generating a flow through the baffle gap.

In U.S. Pat. No. 9,393,574 B1 are presented exchangeable wear inserts for the solids discharge openings of a decanter centrifuge with a holder fixed with screws from the outside. The discharge diameter is not varied in this case.

FR778407A discloses a clarifier and centrifugal separator with liquid evacuation at the bottom through nozzles and with sediment evacuation at the top. The description explains that the clarified liquid is forced to exit at the bottom base through the nozzles, which can be accessed for changing or setting of the nozzles It is disclosed that the nozzles have their length determined so that their inner end, with respect to the thickness of the liquid layer, is such that a desired quantity of water is removed by them; which at the same time regulates the consistency of sediment.

DE3345400A discloses a solid bowl screw centrifuge with sludge discharge nozzles with a control device which allows for periodic opening or closing of the sludge nozzles. According D2 the control device is a rotor being operated as a "Schleusenorgan" at the peripheral area and is volumetrically metering the discharge of the sludge through the available nozzles. The diameter of the nozzle openings is without influence on the discharged sludge volume per time unit The nozzle may be fastened with screws and for sealing the nozzle body against the bowl a sealing body may be used, which thickness may be reduced in order to move the nozzle body inwardly in order to compensate for wear.

None of these solutions incorporate exchangeable or adjustable bushings in a radial manner without changing the outlet cross-section in order to change the solid discharge diameter, thereby reducing the solid flow capacity.

SUMMARY

The disclosure relates to radially adjustable bushings at the solids discharge openings by which the internal cake level can be adjusted to achieve optimal cake moisture or it can be used as an additional parameter to control the decanter. The bushings can be adjusted in such a way as to reduce the total power consumption of the decanter, using hydraulic pressure difference as a scroll transport support.

In the disclosed embodiments, the relative pond depth is generated by varying the solids discharge diameter and by keeping the liquid discharge diameter fixed. This variation is enabled by using exchangeable or adjustable bushings moving the bushing entrance in radial direction together with a special shape of the scroll flight or the bowl at the end of the conical section. The bushings can be screwed or fixed with any system allowing radial movement or by exchangeable bushings with different lengths. Said bushings are oriented relative to the plane perpendicular to the rotational axis with an angle ($\alpha$) in the range of 1° to 90°, preferably 30° to 60°.

BRIEF DESCRIPTION OF THE DRAWINGS

The invention will now be described in further details based on exemplary, but not limiting, embodiments with reference to the drawings. In the drawings:

FIG. 1 shows a schematic cross-sectional view of a decanter centrifuge, according to prior art.

FIG. 2A shows a standard method of changing relative pond level of a decanter centrifuge with sliding weir plates at the liquid phase discharge, according to prior art.

FIG. 2B shows the method of changing relative pond level according to the disclosure.

DETAILED DESCRIPTION

Figure 3:
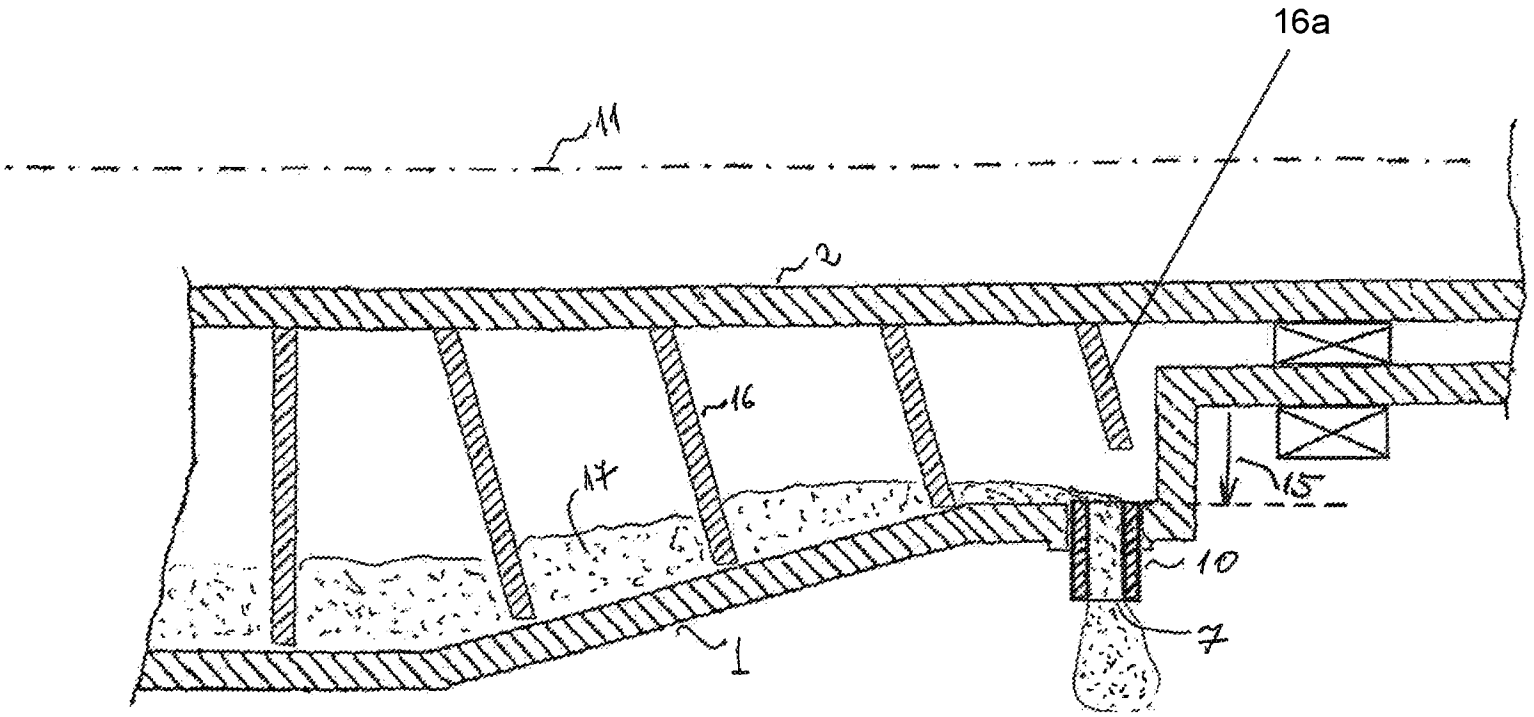
FIG. 3 shows a schematic cross-sectional view in a plane parallel to the rotational axis of a decanter centrifuge at the solids discharge openings side with radially adjustable bushings mounted at the maximum discharge diameter according to one embodiment of the disclosure.

FIG. 1 shows a decanter centrifuge according to the state of the art with a rotating bowl 1 and a scroll conveyor 2 which is pivoted coaxially with the rotating axis of the bowl 1, an axial feed 3, a feed chamber 4, slurry outlet 5, a liquid phase discharge outlet 6 for clear liquid phase and a solids discharge opening 7 for the recovery of the solid phase.

FIG. 2A shows a schematic sketch of a decanter centrifuge according to the state of the art. Here the pond depth 14 is defined by the overflow weir 13 at the liquid phase discharge outlet 6 and results in the liquid discharge diameter. In standard decanters the relative pond depth 12 is generated by varying the diameter of the liquid discharge outlet 6 with sliding or exchangeable weir plates 13 or discharge port members while the solids discharge diameter 15 at solids discharge opening 7 is fixed. In this way the relative pond depth 12 can be varied.

FIG. 2B presents an embodiment where the solids discharge diameter 15 can be changed in a simple and cheap manner by exchanging or adjusting the bushing 10 at solids discharge opening 7. Here the relative pond depth 12 is adjusted by varying the solids discharge diameter 15 by means of radially adjustable bushings or exchangeable bushings 10 with different lengths while the liquid discharge diameter 14 is fixed.

In another embodiment, the relative pond depth 12 is established by changing both discharge diameters at the same time: adjustable or exchangeable weir plates 13 or discharge port members for the liquid discharge and radially adjustable or exchangeable bushings 10 for the solids discharge openings. This invention can also be implemented in a 3-phase decanter and serves to improve the decanter performance.

Figure 4:
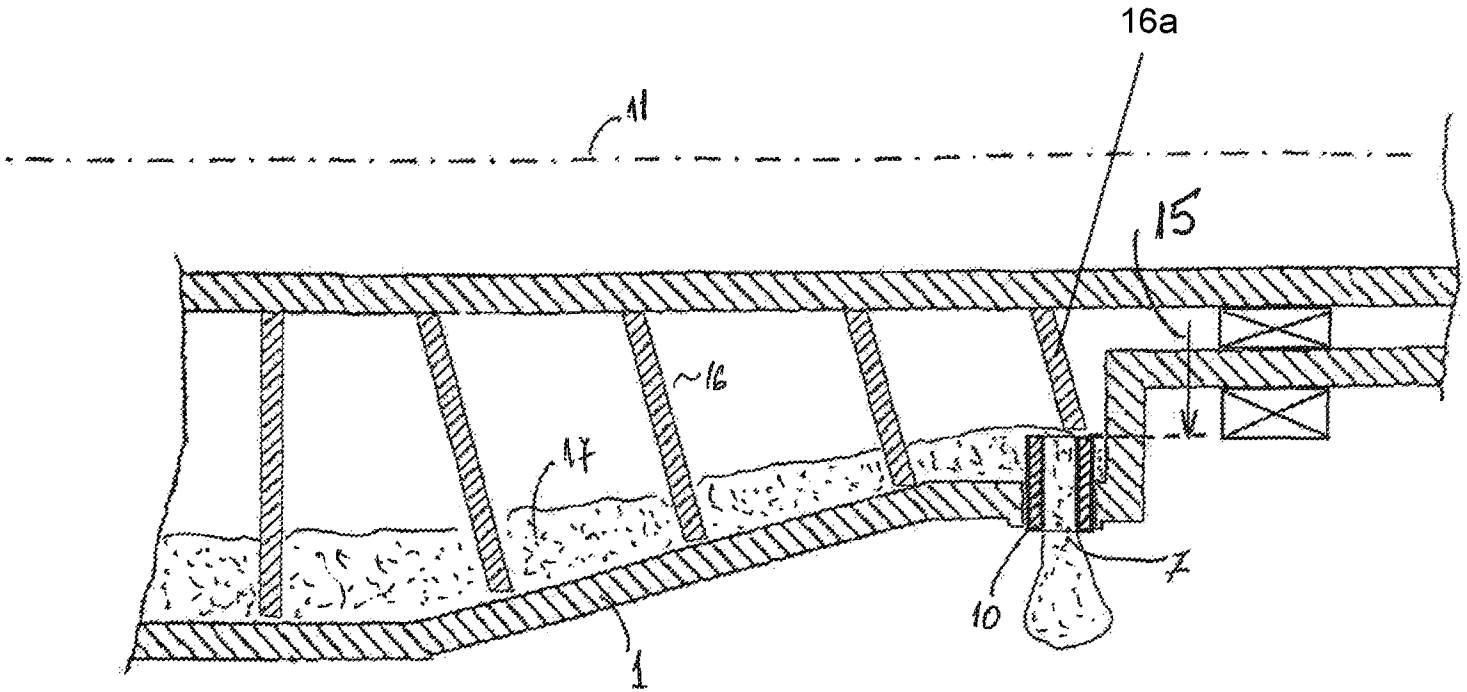
FIG. 4 shows a schematic cross-sectional view in a plane parallel to rotational axis of a decanter at the solids discharge openings with radially adjustable bushings according to the embodiment of FIG. 3 set at the minimum discharge diameter.

FIG. 3 and FIG. 4 show a variant of the invention at the end of the solids discharge openings. The solids 17 are transported by the scroll flights 16 to the solids discharge openings 7. The scroll flight 16*a* is reduced relative to the bowl inner diameter at the position of the solids discharge opening 7 in order to not touch the bushing 10 when the bushing 10 is moved radially inward. This scroll modification does not influence the cake transportation inside the decanter, because at the end of the conical section (close to the flat section) the cake level is low and as conveyed by the scroll, it collapses and it is pushed by the flowing cake to the level of the bushings' edges. When the bushings 10 are set at maximum discharge diameter (close to the bowl inner diameter at the solid discharge openings) as shown schematically in FIG. 3, a cresting is generated at bushings' edges in a similar manner as for liquid discharge. The size of the cresting is depending of cake dryness, product rheology, bowl speed, scroll pitch and speed, outlet surface and shape. In the case of the maximum inward position of bushing 10 presented in FIG. 4 a stagnation cake flow is created mainly in front of the inside part of the bushing 10 generating an additional cone of cake which helps to transport the product at the smaller solids discharge diameter 15.

Figure 5A:
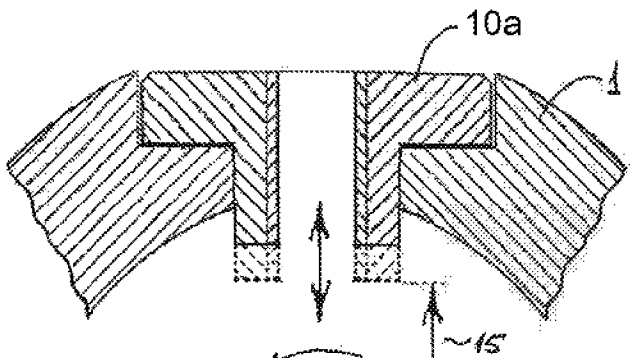
FIG. 5A shows a schematic cross-sectional view in a plane perpendicular to the rotational axis at the middle of solids discharge openings with exchangeable bushings according to another embodiment, allowing the change of solids discharge diameter.
Figure 5B:
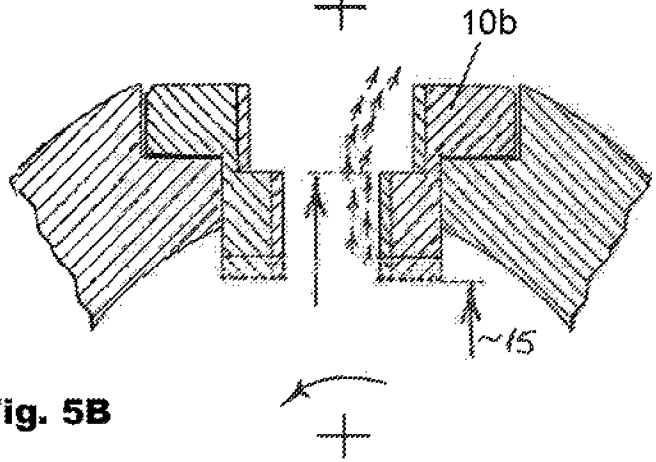
FIG. 5B shows a schematic cross-sectional view in a plane perpendicular to the rotational axis at the middle of solids discharge openings with exchangeable bushings according to another embodiment.
Figure 5C:
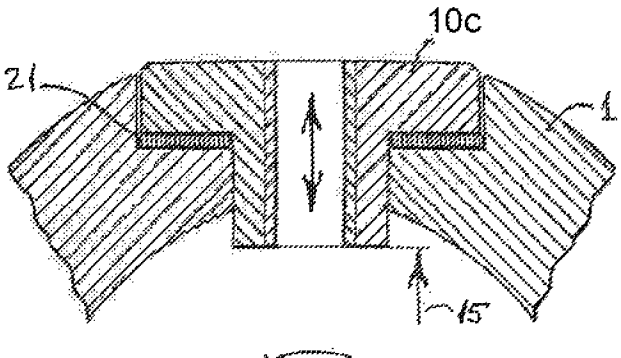
FIG. 5C shows a schematic cross-sectional view in a plane perpendicular to the rotational axis at the middle of solids discharge openings with bushings according to a further embodiment.
Figure 5D:
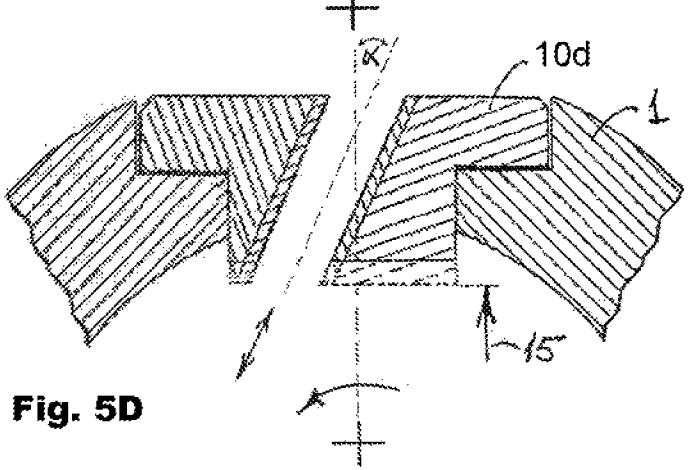
FIG. 5D shows a schematic cross-sectional view in a plane perpendicular to the rotational axis at the middle of solids discharge openings with exchangeable bushings according to another embodiment.
Figure 5F:
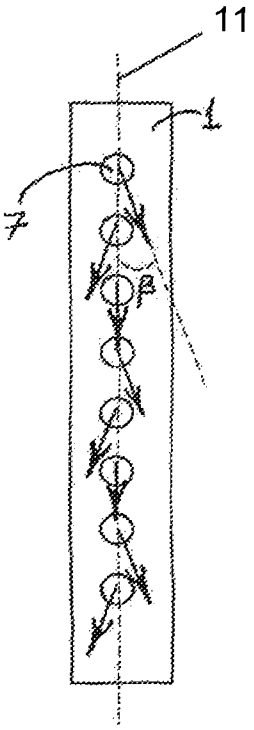
FIG. 5F shows a schematic solids discharge opening arrangement according to another embodiment.
Figure 5E:
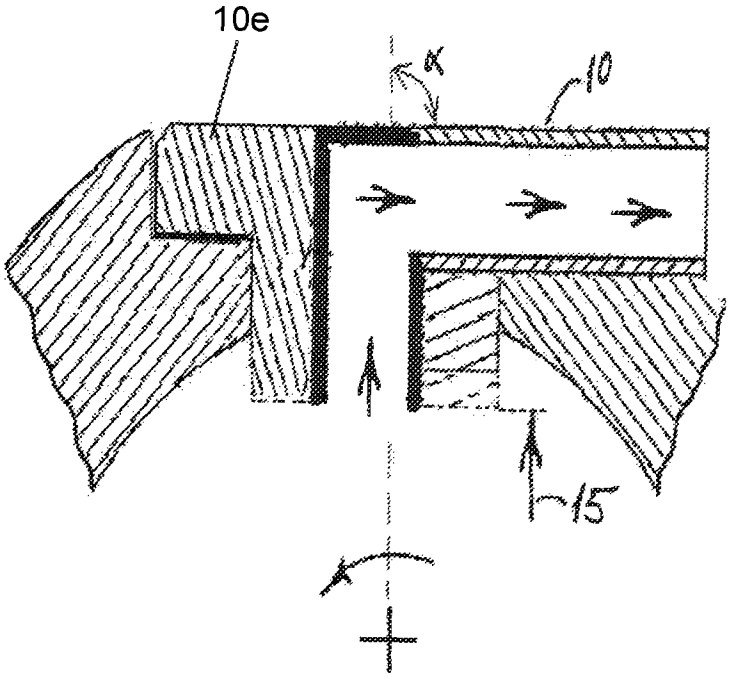
FIG. 5E shows a schematic cross-sectional view in a plane perpendicular to the rotational axis at the middle of solids discharge openings with exchangeable bushings according to a further embodiment.

More embodiments are presented in FIGS. 5A-5F where the exchangeable bushings 10*a*, 10*b*, 10*c* and 10*d* with different lengths are inserted in a holder with a different kind of fixation mechanism. The variation of the solid discharge diameter can be done without changing the bushing 10 by adding different spacers 21 with different thickness between the bowl 1 and the bushing 10*c* (FIG. 5C). The bushing holder allows changing the orientation of the solids discharge opening relative to the bowl rotation and to a plane perpendicular to the rotational axis. Discharging the cake in opposite direction of the bowl rotation is state of the art known in the patent EP 0 798 045 A1 where the changing of flow direction is achieved by manufacturing the opening of the bowl wall in the form of inclined channels angled backwards with respect to the direction of bowl rotation. In the present embodiment, the bowl openings are manufactured in standard radial direction and the changing of the cake flow is done in the bushing holder as shown in FIG. 5B. The modification of cake flow direction relative to bowl speed direction improves the total power consumption and reduces the wear on the hopper. Another embodiment to improve the power consumption is presented on FIG. 5C where the holder bushing is provided with a shoulder to discharge the solids on a smaller diameter relative to the bushing thickness. The wear on the hopper can also be reduced by modifying the cake flow direction at the outlet of the decanter relative to a plane perpendicular to the rotational axis as presented in FIG. 5D. The exchangeable bushing 10*d* may be oriented in the opposite direction of bowl rotation with an angle $\alpha$ in the range of 1°-85°, more preferably in view of an easier manufacture. It is also possible to have an angle $\alpha$ of 90° with a specific bushing 10*e* as shown in FIG. 5E. With such orientation against the direction of bowl rotation the maximum power recovery can be achieved. A further embodiment is shown in FIG. 5F where the discharge is achieved at an offset angle $\beta$ relative to the axis of rotation 11 in the range of −45° to 45°, more preferably between −15° and 15°. This helps to avoid product impact in the same plane from all bushings, thereby reducing the wear on the hopper.

Figure 6B:
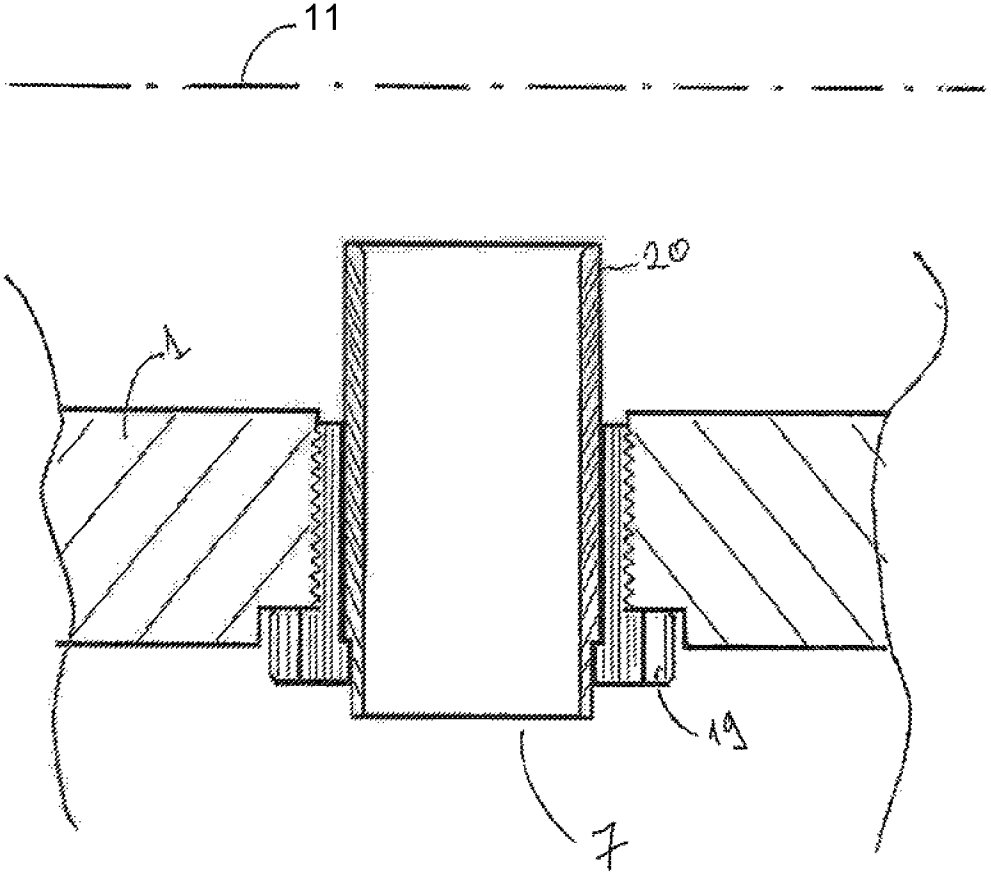
FIG. 6B shows a cross-sectional view at solids discharge openings of an adjustable bushing screwed into the bowl according to one embodiment.
Figure 6A:
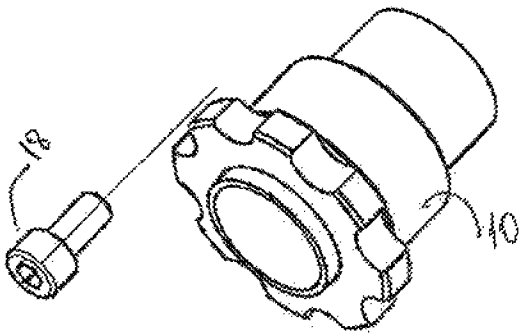
FIG. 6A shows a perspective view of a radially adjustable bushing with a locking mechanism system according to one embodiment.

In FIG. 6A is presented a perspective view of an exemplary radially adjustable bushing 10 according to one embodiment. It is provided with a locking mechanism 18 to avoid that the bushing loosens during the rotation of the decanter. FIG. 6B shows a cross-sectional view of an adjustable bushing mounted on the bowl 1. The bushing holder 19 is screwed into the bowl thread and it is retaining the wear resistant insert 20. The drawing is showing a round shape of the insert cross-section but it can be manufactured with any other shape and mounted in the holder 19.

The example in FIG. 6A and FIG. 6B is showing but not limiting the fixation mechanism of radially adjustable or exchangeable bushings 10 used to adjust the solid discharge overflow diameter 15.

The invention is not limited to the examples shown in the drawings. It may be used for any kind of decanter where the discharge of liquid and solids and thus the separation shall be adjusted.

The invention claimed is:

1. A decanter centrifuge comprising:

a centrifugal bowl (1) rotatable around an axis (11) at a speed and including at least one liquid phase discharge outlet (6) at a first end and at least one solids discharge opening (7) at an opposite second end;

a scroll conveyor (2) mounted substantially coaxially inside the centrifugal bowl (1) for rotation about said axis (11) at a speed that is different from the speed of rotation of the centrifugal bowl (1) for transporting a solid phase towards said solids discharge opening (7), wherein the liquid phase discharge outlet (6) includes port members, and a set of bushings (10) is provided at the at least one solids discharge opening (7), the bushings (10) configured to adjust a diametric position from which solids discharge from the bowl (1) thereby defining a discharge overflow diameter (15) inside the bowl (1).

2. The decanter centrifuge according to claim 1, wherein the set of bushings (10) includes a plurality of bushings and the bushings in the set are exchangeable with one another.

3. The decanter centrifuge according to claim 1, wherein bushings in said set (10) are radially adjustable relative to said axis (11).

4. The decanter centrifuge according to claim 1, wherein one or more bushings in said set (10) is screwed to said centrifugal bowl (1), fixed relative to said centrifugal bowl (1), provided with a spacer (21), or a combination thereof.

5. The decanter centrifuge according to claim 1, wherein one or more bushings in said set (10) is mounted with a system that allows changing of the discharge overflow diameter (15) inside the bowl (1).

6. The decanter centrifuge according to claim 1, wherein one or more bushings in said set (10) is manufactured from wear resistant material.

7. The decanter centrifuge according to claim 1, wherein one or more bushings in said set (10) defines a flow path that is orientated in a direction opposite the direction of the bowl rotation.

8. The decanter centrifuge according to claim 1, wherein one or more bushings in said set (10) is provided with an outwardly extending shoulder.

9. The decanter centrifuge according to claim 1, wherein one or more bushings in said set (10) defines an opening that is oriented relative to a plane perpendicular to the rotational axis (11) at an angle (a) within a range of 1° to 90°.

10. The decanter centrifuge according to claim 9, wherein the angle (a) is within a range of 30° to 60°.

11. The decanter centrifuge according to claim 1, wherein one or more bushings in said set (10) defines an opening that is oriented such that the solid discharge is achieved at an angle (13) relative to the rotational axis (11) within a range of −45° to 45°.

12. The decanter centrifuge according to claim 11, wherein the angle (13) is within a range of −15° to 15°.

13. The decanter centrifuge according to claim 1, wherein said liquid discharge outlet (6) is provided with weir plates (13).

14. A decanter centrifuge comprising:

an axially extending centrifugal bowl (1) with a bowl wall rotatable around a central axis (11) and including at least one liquid phase discharge outlet (6) through the bowl wall positioned proximate a first axial end and at least one solids discharge opening (7) through the bowl wall positioned proximate an opposite second end;

a scroll conveyor (2) mounted substantially coaxially inside the centrifugal bowl (1) rotatable about said axis (11) independently from rotation of the centrifugal bowl (1), the scroll conveyor (2) configured for transporting a solid phase towards said solids discharge opening (7) via scroll flights (16), and a plurality of bushings (10), each bushing of the plurality of bushings (10) being engageable within one of the at least one solids discharge opening (7) and defining a pathway through the respective discharge opening (7) from a first end to a second end, at least one of said bushings (10) being movable in a radial direction relative to the axis (11) to adjust a diametric position of the first end of the pathway relative to the bowl wall, thereby adjusting a diametric position through which the solid phase being transported by the scroll conveyor (2) discharges from the bowl (1) and defining a discharge overflow diameter (15) inside the bowl (1).

15. A decanter centrifuge comprising: an axially extending centrifugal bowl (1) having an outer wall that defines an interior and being rotatable about a central axis (11), the centrifugal bowl (1) including at least one liquid phase discharge outlet (6) through the wall positioned at a first axial end and at least one solids discharge opening (7) through the wall positioned at an opposite second end, a scroll conveyor (2) mounted substantially coaxially inside the centrifugal bowl (1) rotatable about said axis (11) independently from rotation of the centrifugal bowl (1), the scroll conveyor (2) including a plurality of scrolls (16) that transport solids axially toward the solids discharge opening (7), and a first bushing (10) engageable within one of the at least one solids discharge opening (7), the bushing defining a pathway through the discharge opening (7) from a first end positioned toward the interior of the bowl (1) for receiving solids from the interior of the bowl (1) to an opposite second end for discharging solids from the bowl (1), the first bushing (10) being movable in a radial direction relative to the axis (11) to alter the position of the first end relative to the wall, thereby altering the diametric position at which the solids are received from the interior of the bowl for discharge from the bowl (1) and defining a discharge overflow diameter (15) inside the bowl (1).

16. The decanter centrifuge of claim 15, comprising a second bushing (10) engageable within the one of the at least one solids discharge opening (7), the second bushing defining a pathway through the discharge opening (7) from a first end positioned toward the interior of the bowl (1) for receiving solids from the interior of the bowl (1) to an opposite second end for discharging solids from the bowl (1), wherein the second bushing is not identical to the first bushing.

17. The decanter of claim 16, wherein the pathway of the first bushing extends relative to a plane perpendicular to the rotational axis (11) at an angle (a) within a range of 30° to 60°.

18. The decanter of claim 15, wherein the pathway of the first bushing is non-linear.

19. The decanter of claim 15, wherein the pathway of the first bushing extends from its first end to its second end in a relative direction opposite from the direction of transport of solids by the scroll conveyor (2).

* * * * *